US006125773A

United States Patent [19]

Coble

[11] Patent Number: 6,125,773

[45] Date of Patent: Oct. 3, 2000

[54] CABLE SYSTEM FOR OPERATING FURNACE DOORS

[76] Inventor: Gary L. Coble, R.D. #2, Box 214, DuBois, Pa. 15801

[21] Appl. No.: 09/126,151

[22] Filed: Jul. 30, 1998

[51] Int. Cl.[7] ..... F23M 7/00

[52] U.S. Cl. ..... 110/176; 110/172; 126/191; 126/192; 49/360; 49/361; 202/242

[58] Field of Search ..... 110/173 R, 176, 110/172; 212/166; 126/190, 191, 192, 197; 49/360, 361; 34/201; 202/88, 242; 219/391, 394; 312/236, 306, 312

[56] References Cited

U.S. PATENT DOCUMENTS

| | | | |
|---|---|---|---|
| 555,856 | 3/1896 | Forter | 110/176 |
| 741,812 | 10/1903 | Monfort | 110/173 R |
| 1,399,127 | 12/1921 | Kling | 110/176 |
| 1,448,480 | 3/1923 | Bedell | 110/176 X |
| 1,752,806 | 4/1930 | Otis | 110/176 X |
| 2,024,649 | 12/1935 | Longenecker | 110/173 |
| 2,045,662 | 6/1936 | Longenecker | 110/173 R |
| 2,119,426 | 5/1938 | Douglas et al. | 110/173 R |
| 2,233,650 | 3/1941 | Swartz | 110/180 |
| 2,330,728 | 9/1943 | Mayer | 110/173 |
| 2,494,713 | 1/1950 | Longenecker | 110/176 |
| 2,507,360 | 5/1950 | Wicks | 110/173 |
| 2,532,841 | 12/1950 | Hanff | 110/176 |
| 2,594,188 | 4/1952 | Longenecker | 110/173 |
| 2,600,441 | 6/1952 | Sommers et al. | 110/173 R X |
| 2,735,386 | 2/1956 | Longenecker | 110/176 |
| 2,747,527 | 5/1956 | Fuller | 110/176 |
| 2,953,108 | 9/1960 | Kelsen | 110/173 R |
| 3,298,546 | 1/1967 | Jones | 214/18 |
| 3,463,468 | 8/1969 | Hobbs | 110/173 R X |
| 4,647,022 | 3/1987 | Coble | 266/282 |
| 4,653,171 | 3/1987 | Coble | 29/455 |
| 4,884,556 | 12/1989 | Alden et al. | 126/190 X |
| 5,308,046 | 5/1994 | Coble | 266/263 |
| 5,335,897 | 8/1994 | Coble | 266/286 |
| 5,483,548 | 1/1996 | Coble | 375/75 |
| 5,727,479 | 3/1998 | McAfee et al. | 110/176 |

FOREIGN PATENT DOCUMENTS

| | | | |
|---|---|---|---|
| 362228 | 12/1931 | United Kingdom | 110/173 R |

*Primary Examiner*—Ira S. Lazarus
*Assistant Examiner*—Ljiljana V. Ciric
*Attorney, Agent, or Firm*—David A. Burge

[57] ABSTRACT

A cable system for raising and lowering a door of an industrial furnace utilizes a pair of vertically extending cables having lower ends connected to the door and upper ends connected to shaft-carried sheaves that are rotated concurrently to cause upper portions of the cables to be wound onto and off of the sheaves to raise and lower the furnace door to open and close a furnace opening defined in a vertical furnace face. The cables wind onto and off of sheave-defined tracks that are configured to cause lower portions of the cables to move the door a small distance horizontally during raising and lowering. This small distance horizontal movement capability may be utilized at the initiation of door raising to move the door away from the furnace face, and at the conclusion of door lowering to close the door against the furnace face to close the furnace opening. Where a pair of cable supported doors cooperate to close left and right ends of a furnace opening, the horizontal movement capability may be utilized to move adjacent ends of the doors away from each other as the doors are raised, and to move the adjacent door ends toward each other as the doors are lowered to bring the adjacent door ends together so they can cooperate to close the furnace opening.

30 Claims, 4 Drawing Sheets

CABLE SYSTEM FOR OPERATING FURNACE DOORS

BACKGROUND OF THE INVENTION

1. Field of the Invention

The present invention relates generally to a cable system for raising and lowering one or more door panels of an industrial furnace to at least partially open and close a furnace opening that is defined where an access passage opens through a substantially vertically extending furnace face, for example in a steel reheat furnace or the like, with door support cables being wound onto specially configured tracks of shaft-carried sheaves or the like to introduce horizontal components of movement during door raising and door lowering. In one embodiment, a cable system for raising and lowering furnace doors introduces horizontal components of movement as one or more furnace doors are opened and closed to effect door movement away from the furnace face during raising, and door movement toward and into seated engagement with the furnace face during lowering. In embodiments where a plurality of doors are arranged end-to-end to cooperatively close an elongate furnace opening, horizontal components of movement preferably are introduced during door raising to separate adjacent ends of adjacent pairs of the doors, and during door lowering to bring the adjacent door ends toward and into engagement with each other so the doors will cooperate properly to close the furnace opening.

2. Prior Art

Large industrial furnaces such as steel reheat furnaces and the like utilize large furnace door panels to open and close large furnace openings through which large objects such as steel billets must pass when moving into and out of furnace chambers. Reheat furnace openings as tall as six to eight feet and/or as wide as sixteen to eighteen feet are not unusual. To withstand lengthy exposures to the energy emanating from high heat furnace environments, furnace door panels typically are provided with an inner face formed from solid refractory elements, with small spaces therebetween typically being filled with refractory cement, and with added layers of insulation being provided between and behind the refractory elements. To rigidly support the solid refractory materials and accompanying insulation, heavy, perimetrically extending steel frames are employed that support grid-like arrays of interconnected steel components. The resulting door panel assemblies are quite heavy, often weighing between about 4000 and about 8000 pounds.

Known cable systems for raising and lowering industrial furnace door panels doors typically raise and lower the door panels along vertically extending, substantially linear paths of travel. Stated in another way, the door panels are not deliberately caused to execute horizontal movements while being opened and closed, and hence the raising and lowering movements of each door panel tend to take place substantially within a single vertically extending plane, with door movements including no intentionally provided horizontal components of movement.

In industrial environments such as those presented by steel mills, it is important that the cable systems that are used to open and close heavy furnace doors of high heat furnaces be of rugged yet simple construction to minimize the possibility of breakdown and the need for maintenance, and so that, in the event that a problem with a broken cable or other component is encountered, it can be easily diagnosed and quickly corrected. To the extent that present day cable-operated furnace door positioning systems exhibit a degree of complexity, this is usually limited to the addition thereto of such cable reaches and pulleys as may be needed to connect the door panels to movable counterweights that are provided so that door panel movement can be accomplished through the application of external forces of relatively small magnitudes.

Because increases in complexity often bring with them increased risks of failure and resulting "down time," and because component failures in the environment of a steel mill can present very real safety concerns, it is understandable that knowledgeable and experienced personnel often tend to resist the implementation of changes that introduce "complexities. " It is equally understandable that, in in the interests of "keeping systems simple," some operating problems tend to be viewed as "tolerable." One tolerated problem has been damage and wear due to rubbing, bumping and occasional impacts of a raised door panel against furnace face components. As a present-day cable-supported door panel is raised, it tends to rub against adjacent furnace face components causing wear and a need for maintenance and replacement of worn components. Bumping and more severe impacts between the door panel and the furnace face may cause even greater damage and attendant "down time" for maintenance and replacement of broken components. Door service life can be dramatically shortened if brittle solid refractory components are damaged or broken due to impact.

Another tolerated problem has been damage and wear due to bumping and impact of adjacent ends of left and right door panels in installations where door panels arranged end-to-end are used to cooperatively close relatively wide or elongate furnace openings. When adjacent door panels are closed, their adjacent ends should engage to properly close the furnace opening. However, when one or both of the door panels are raised to at least partially open the furnace opening, the adjacent ends of adjacent door panels may move relative to each other while in engagement, thereby causing wear, or may impact and damage each other if one or both of the raised, cable-supported door panels is struck or otherwise caused to swing on its cables.

Unfulfilled by the prior art is a long-standing need for a simple and reliable cable system that is well suited for use in an industrial environment such as that of a steel mill that will minimize engagement, bumping and impact problems of raised furnace door panels in an effort to eliminate wear, breakage, safety concerns and attendant "down time" due to unwanted engagements with cable supported furnace door panels during raising and lowering movements, and while the door panels are supported by cables while in open positions.

SUMMARY OF THE INVENTION

The present invention addresses the foregoing and other needs and drawbacks of the prior art by providing a cable system for raising and lowering one or more furnace door panels to open and close a furnace opening formed through a substantially vertically extending face of an industrial furnace—a system wherein one or more cable reaches that support the door panels during raising and lowering wind onto and off of tracks defined on rotatable sheaves or drums, with the tracks being configured to interact with the cables to effect small distance horizontal movements of the door panels. These small distance horizontal movements are utilized, for example, to separate the door panels during lifting from other furnace elements that reside adjacent the door panel when the door panel is closed, and to thereby minimize the rubbing, bumping and impacting of the cable-supported door panels against other furnace elements when the door panels are raised out of their closed positions.

In one simple form, the present invention consists of reaches of cable that extend upwardly from a furnace door, a means for raising and lowering these cable reaches to raise and lower the furnace door, and a means for engaging the cable reaches to move them short distances horizontally to effect corresponding short distance horizontal movements of the furnace door as the door is being raised and lowered. In a more sophisticated form, the present invention utilizes rotatable sheaves, drums or the like that connect with upper portions of the vertically extending cable reaches to concurrently perform both the task of vertically moving the cable reaches to raise or lower the door, and the task of horizontally moving the cable reaches to impart desired horizontal movements to the door. As will be made more clear in the detailed description that appears later herein, additional sophistication preferably is provided by tailoring the character of connections that are formed between the cables and the rotatable drums or sheaves, and by tailoring the configuration of cable-receiving tracks that are defined by the drums or sheaves to achieve desired types of horizontal door movements that are coordinated with selected portions of raising and lowering movements of furnace doors.

In preferred practice, the present invention provides a system for raising and lowering one or more furnace door panels to at least partially open and close a furnace opening of the type that is defined where a furnace access passage opens through a substantially vertically extending face of an industrial furnace such as a steel reheat furnace or the like, wherein the door panels are supported during raising and lowering by reaches of flexible cable, with top portions of the cable reaches being wound onto and off of curved tracks defined by drums, sheaves or the like that are rotated in one direction to raise the door panels and in an opposite direction to lower the door panels, wherein the curved tracks interact with the cable as the cable is being wound onto and off of the curved tracks to effect small distance horizontal movements of the door panel—movements that are used, for example 1) to draw the furnace door panels away from the furnace face during raising to minimize undesirable contact between the elevated door panels and the furnace face, 2) to draw the door panels toward and into seated engagement with the furnace face as the door panels are lowered to at least partially close the furnace opening, 3) to separate, during lifting, adjacent door panel ends in installations where a pair of furnace door panels are used to at least partially close opposite end regions of a relatively wide furnace opening, and 4) to move the adjacent door panel ends into engagement as the adjacent door panels are lowered to at least partially close the relatively wide furnace opening.

BRIEF DESCRIPTION OF THE DRAWINGS

Other features and a fuller understanding of the invention may be had by referring to the following description and claims taken in conjunction with the accompanying drawings, wherein:

DESCRIPTION OF THE PREFERRED EMBODIMENT

Figure 2:
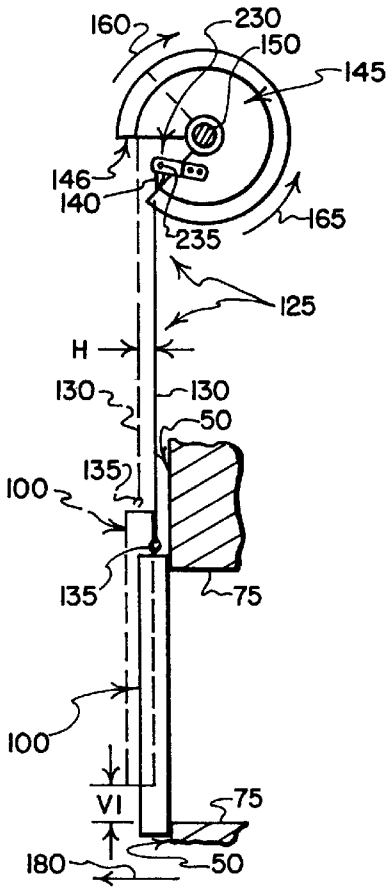
FIG. 2 is an end elevational view thereof, but with counterweight elements removed, and with portions of the furnace face broken away to permit the furnace opening of FIG. 1 to be depicted by solid lines.

Referring to FIGS. 1–4, an upstanding face of an industrial furnace, such as a steel reheat furnace, is indicated generally by the numeral 50. An opening that provides access through the furnace face 50 to interior portions of the furnace is indicated generally by the numeral 75. A furnace door panel that can be raised and lowered to open and close the furnace opening 75 is indicated generally by the numeral 100.

Figure 1:
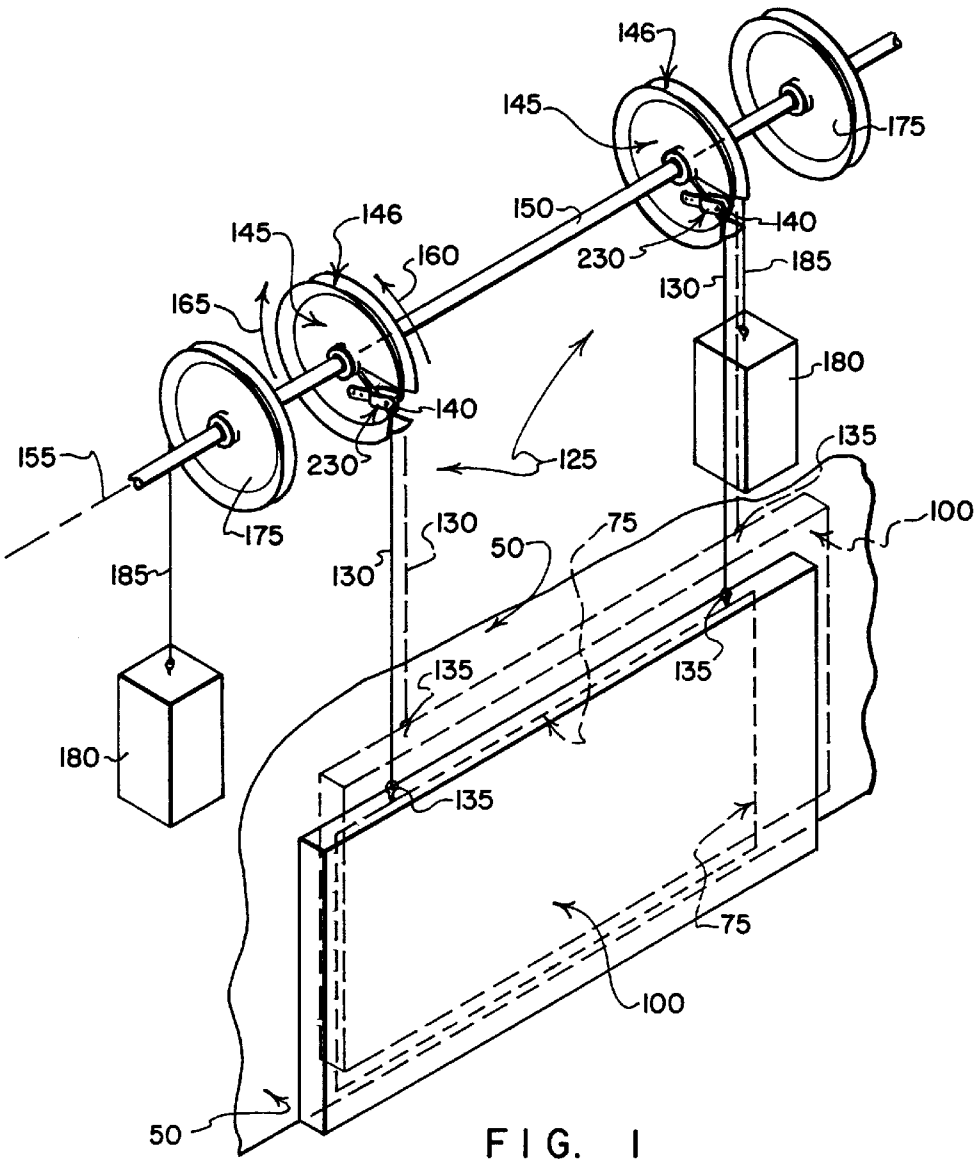
FIG. 1 is a perspective view that depicts, in solid lines, the closed position of a furnace door panel wherein the door panel is seated against an upstanding furnace face and closes a furnace opening that is defined by the furnace face, and depicting in broken lines a partially raised position of the door panel.
Figure 4:
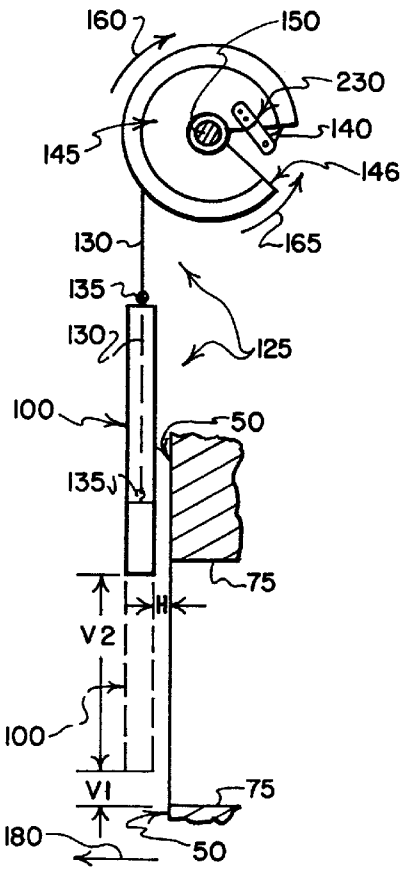
FIG. 4 is an end elevational view thereof, but with counterweight elements and furnace portions removed as in FIG. 2.
Figure 3:
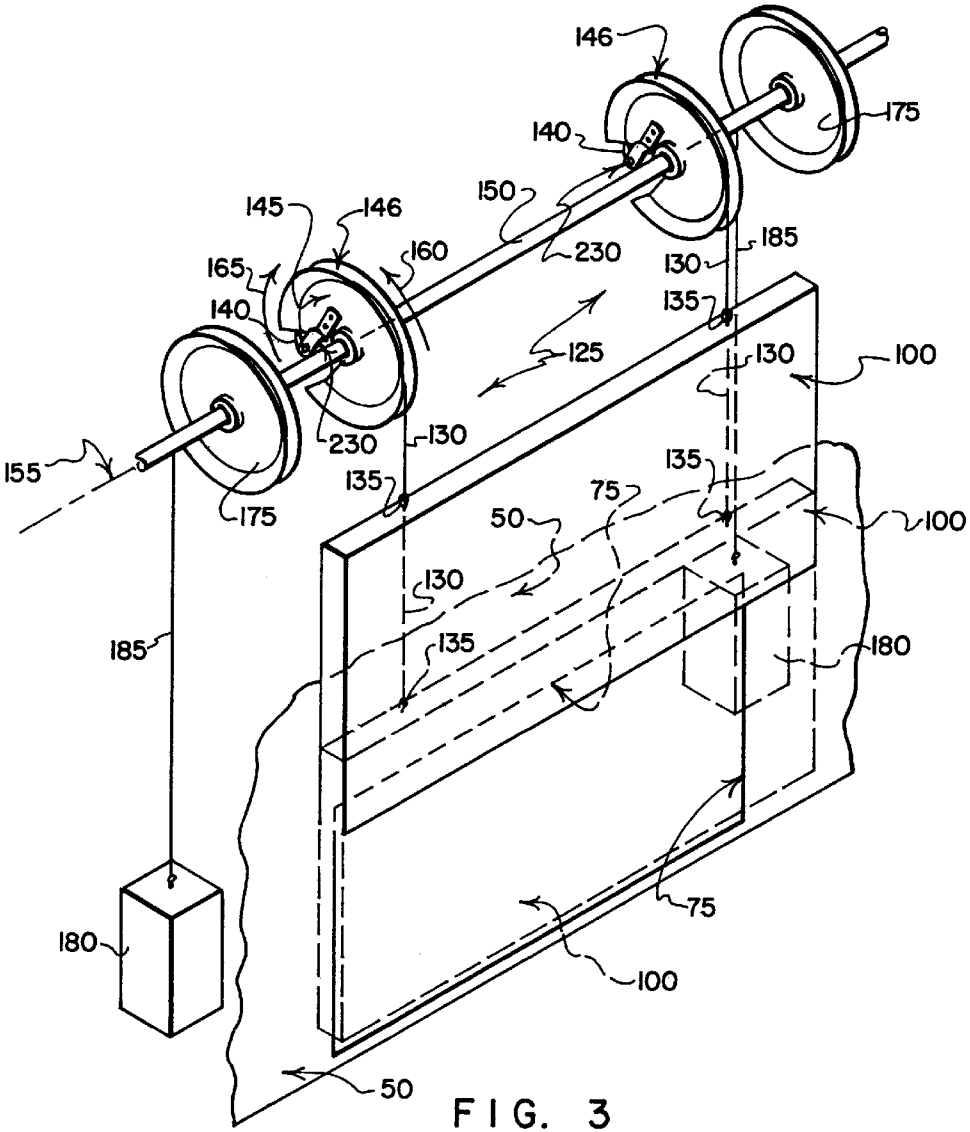
FIG. 3 is a perspective view similar to FIG. 1 that depicts, in solid lines, the open position of the furnace door panel wherein the door panel disengages the furnace face and opens the furnace opening, and depicting in broken lines, the same partially raised position of the door panel that is indicated by broken lines in FIG. 1.

In FIGS. 1 and 2, solid lines depict what will be referred to as the "closed position" of the door panel 100—a position wherein the door panel 100 is seated against the furnace face 50 and closes the opening 75. In FIGS. 3 and 4, solid lines depict what will be referred to as the "open position" of the door panel 100—a position wherein the door panel 100 has moved forwardly (in a direction indicated in FIGS. 2 and 4 by arrows 180) to disengage the furnace face 50, and has raised so as to provide access to interior portions of the furnace through the opening 75. Depicted by broken lines in FIGS. 1–4 is a slightly raised "intermediate position" of the door panel 100 wherein full forward movement of the door panel 100 has been achieved to disengage the door panel 100 from the furnace face 50, but wherein the door panel 100 has been raised only a short distance out of its closed position to only slightly open the furnace opening 75.

Referring to FIGS. 1–4, a cable system for raising and lowering the door panel 100 to move the door panel 100 between its open and closed positions is indicated generally by the numeral 125. The cable system 125 includes a pair of door support cables 130 that have their lower end regions 135 connected to the door panel 100, and their upper end regions 140 connected to door support sheaves 145.

A single shaft 150 supports and interconnects the sheaves 145 for concurrent rotation. The shaft 150 has a central axis 155 (see FIG. 1) about which it is rotatable in a first direction, indicated by an arrow 160, and in an opposite direction, indicated by an arrow 165. When the shaft 150 is rotated in the first direction 160, upper portions of the door support cables 130 wind onto curved grooves or tracks 146 that extend along the perimeters of the sheaves 145. As the upper portions of the door support cables 130 wind onto and are received within the tracks 146, lower portions of the cables 130 are raised, thereby causing the door panel 100 to be raised out of the door's closed position. When the shaft 150 is rotated in the opposite direction 165, upper portions of the door support cables 130 unwind from the door support sheaves 145, which causes lower portions of the cables 130 to lower the door panel 100 toward its closed position.

Counterweight sheaves 175 are carried near opposite end regions of the shaft 150. Counterweights 180 are supported by counterweight cables 185 that extend upwardly from the counterweights 180 and are wound onto the sheaves 175 so as to wrap in the direction 165 about the axis 155 of the shaft 150—which is opposite to the direction 160 in which the door support cables 130 wrap about the axis 155 of the shaft 150. As the door support cables 130 wrap onto the door support sheaves 145, the counterweight cables 185 unwrap from the counterweight sheaves 175, and vice versa. Thus, as the door panel 100 is raised, the counterweights 180 are lowered, and vice versa—which makes it possible to raise and lower the door panel 100 by applying relatively low torque to the shaft 150.

In preferred practice, the sheaves 145 are identical one with another, and the door support cables 130 are identical one with another. Since each of the sheaves 145 is connected to a separate one of the door support cables 130, each sheave 145 can be said to have an "associated" door support cable 130—and each of the door support cables 130 can be said to have an "associated" sheave 145.

Figure 7:
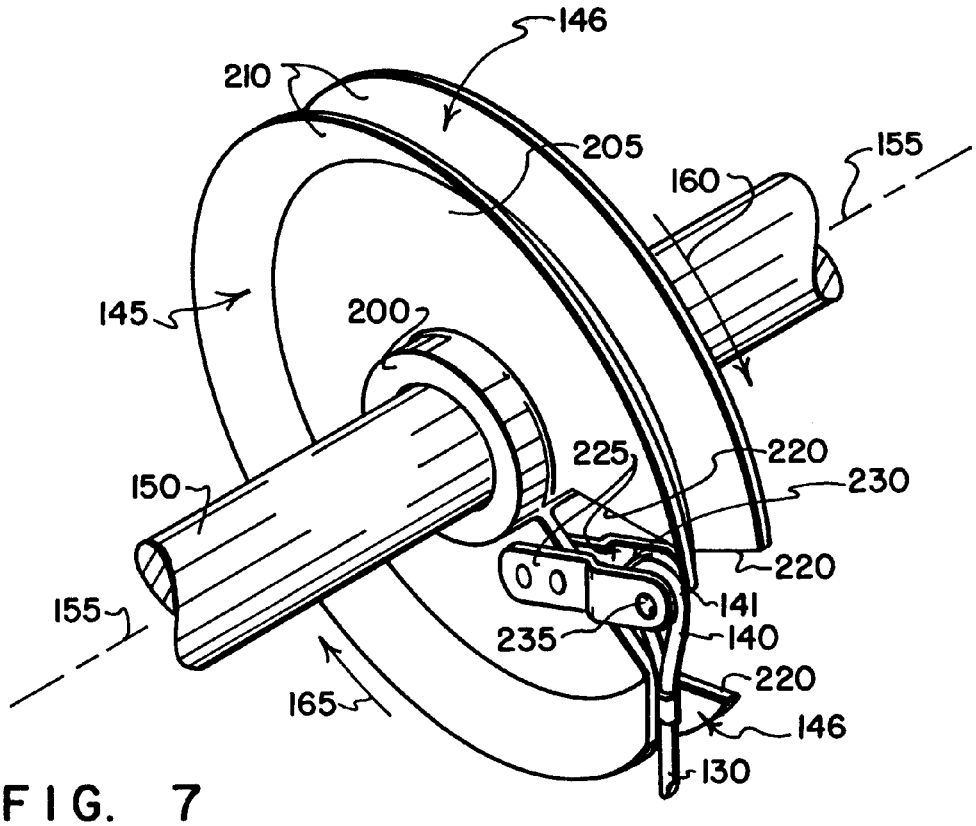
FIG. 7 is a perspective view, on an enlarged scale, depicting one of the door support sheaves shown in FIG. 1 and a connection of a door support cable thereto; and, FIG. 8 is a perspective view, on an enlarged scale, depicting one of the right door support sheaves shown in FIG. 5 and a connection of a right door support cable thereto, it being understood that the left door support sheaves have a configuration that is a mirror image reversal thereof.

Referring to FIG. 7, one of the sheaves 145 and an upper end region 140 of an associated one of the door support cables 130 are shown. The depicted sheave 145 has a centrally located hub 200 through which the shaft 150 extends, and to which the shaft 150 is rigidly connected. The sheave 145 also has a disc-like central portion 205 that connects with a rim 210 that defines the curved, perimetrically extending, cable receiving track 146. A generally triangular notch 220 is formed in one side of the sheave 145. The notch 220 extends into the central portion 205 and also interrupts the rim 210 and the track 146.

To connect the door support sheaves 145 with the door support cables, 130, suitable connectors may be provided on the sheaves 145 to receive suitable connection formations carried by the upper end regions of the cables 130. Referring to FIG. 7, a pair of straps 225 have their inner end regions connected to the central portion 205 of the depicted sheave 145, and have their outer end regions positioned to extend in spaced relationship on opposite sides of the triangular notch 220 to define opposite sides of a yoke 230. An eyelet 141 is provided on the upper end region 140 of the depicted door support cable 130. The eyelet 141 extends into the triangular notch 220 and is received within the yoke 230. A connection pin 235 extends through aligned holes formed through opposite sides of the yoke 230 and through the eyelet 141 to connect the cable 130 to the sheave 145. The yoke 230 and the connection pin 235 cooperate to position the upper end region 140 of the cable 130 in alignment with the track 146 so that, when the sheave 145 rotates in the direction 160, upper portions of the cable 130 will be received by the track 146 as the cable 130 winds onto the sheave 145.

Referring to FIG. 2, the sheaves 145 only need to rotate about one-eighth to about one-quarter of a revolution to move the door panel between the solid-line-depicted "closed position" and the broken-line-depicted "intermediate position"—for movement between these two positions requires only a small amount of vertical door movement, indicated by the dimension V1, and only a small amount of horizontal door movement, indicated by the dimension H. Referring to FIG. 4, a more significant rotation of the sheaves 145 is needed to move the door panel between the broken-line-depicted "intermediate position" and the solid-line-depicted "open position"—for movement between these two positions requires that upper end regions of the cables 130 be wound onto the grooves or tracks 146 of the sheaves 145 for sufficient distances to raise the door panel through a vertical distance indicated by the dimension V2.

Raising the door panel 100 through a combination of the distances V1 and V2 is what is needed to move the door panel 100 from the closed position, depicted in solid lines in FIGS. 1 and 2, to the open position, depicted in solid lines in FIGS. 3 and 4. During such raising, however, the door panel 100 only moves forwardly by the distance H—and all of this H-type horizontal movement takes place while the door panel 100 is being raised through the relatively short height V1. No H-type horizontal movement takes place while the door panel 100 is being moved through the distance V2—which is true regardless of whether the door panel 100 is being raised through the distance V2 or lowered through the distance V2.

Stated in another way, H-type forward movement (in the direction of arrow 180, see FIG. 2) takes place during initial raising of the door panel 100 from its closed position through the distance V1; and, H-type rearward movement (in a direction opposite to the arrow 180) takes place during final lowering of the door panel 100 into its closed position through the distance V1. By this arrangement, the door panel 100 is moved quickly away from the furnace face 50 just as the door panel is initially raised out of its closed position—to thereby prevent rubbing and dragging of the door panel on the furnace face 50—and is moved back into seated engagement with the furnace face 50 only as the door panel is finally lowered into its closed position. The short horizontal distance H through which the door panel 100 moves during initial opening and final closing corresponds to the horizontal distance that the sheave-carried connection pins 235 move during the initial rotation of the sheaves 145 during door panel opening, and to the horizontal distance that the sheave-carried connection pins 235 move during final rotation of the sheaves 145 during door panel closure.

Figure 6:
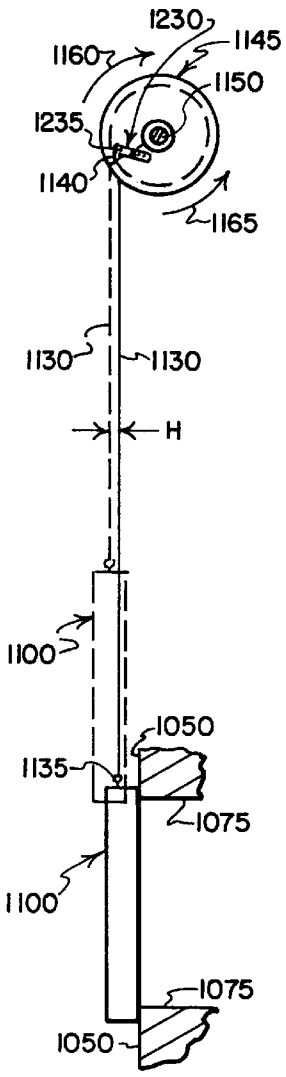
FIG. 6 is a sectional view, as seen from a plane indicated by a line 6—6 in FIG. 5.
Figure 5:
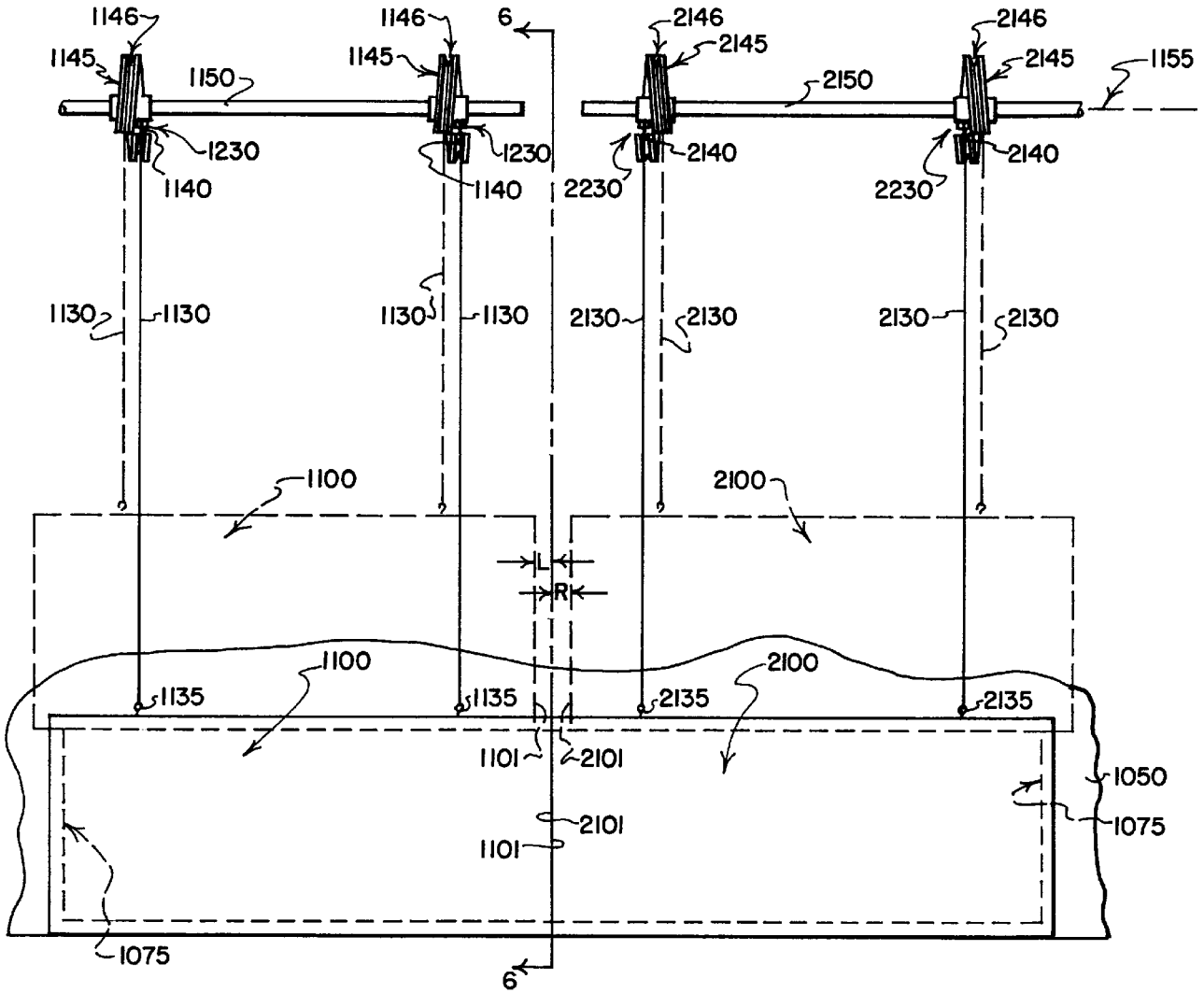
FIG. 5 is a front elevational view that depicts, in solid lines, a set of left and right furnace door panels in closed position engaging an upstanding furnace face and cooperating to close a lengthy furnace opening formed through the furnace face, and that depicts, in broken lines, the left and right door panels in open position disengaged from the furnace face and cooperating to open the furnace opening.
Figure 8:
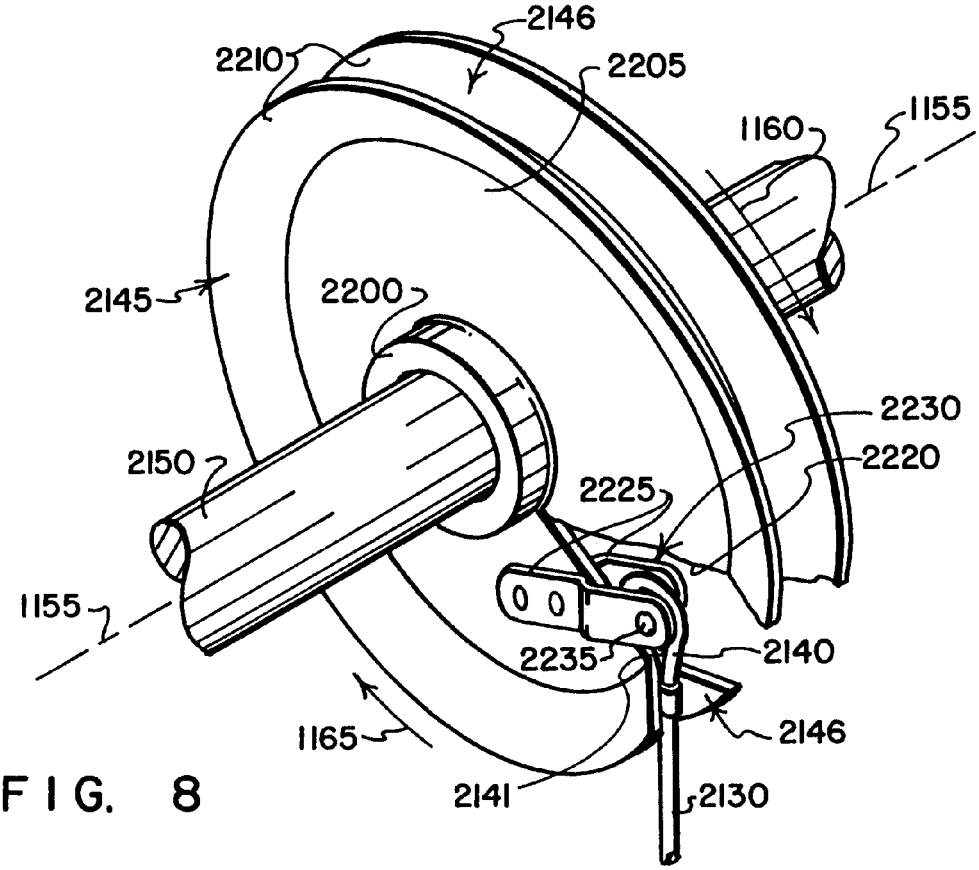

In the embodiment of FIGS. 1–4 and 7, H-type forward-rearward door panel movements are used only to prevent the door panel 100 from engaging nearby furnace components, such as the furnace face 50, while the door panel 100 is raised out of its closed position. In the embodiment of FIGS. 5, 6 and 8, additional left and right horizontal components of door panel movement (i.e., "L-type" and "R-type" movements) are introduced to prevent the door panels 1100, 2100 from engaging each other while raised out of closed positions. While only L-type or only R-type or only H-type movements can be used alone to advantage in some types of furnace door installations, these three types of movement are utilized in combination to achieve maximum advantage in the embodiment of FIGS. 5, 6 and 8.

Referring to FIGS. 5 and 6, a furnace opening 1075 is formed through an upstanding furnace face 1050. The left and right door panels 1100, 2100 can be raised and lowered to open and close the furnace opening 75. Solid lines depict the "closed positions" of the door panels 1100, 2100—positions wherein the door panels 1100, 2100 are seated against the furnace face 1050 and have adjacent panel ends 1101, 2101 engaging so that the door panels 1100, 2100 cooperate to close the opening 1075. Broken lines depict the "open positions" of the door panels 1100, 2100—positions wherein the door panels 1100, 2100 cooperate to provide access to interior furnace portions through the opening 1075, wherein H-type movement has taken place to disengage the door panels 1100, 2100 from the furnace face 1-5-, and wherein left and right movements of the left and right door panels 1100, 2100, have taken place, respectively, to disengage the door panel end surfaces 1101, 2101 from each other.

A cable system for raising and lowering the door panels 1100, 2100 to move the door panels 1100, 2100 between their open and closed positions is indicated by the numeral 1125. The cable system 1125 includes a pair of left door support cables 1130 that have their lower end regions 1135 connected to the left door panel 1100, and their upper end regions 1140 connected to left door support sheaves 1145; and a pair of right door support cables 2130 that have their lower end regions 2135 connected to the right door panel 2100, and their upper end regions 2140 connected to right door support sheaves 2145.

A left shaft 1150 supports and interconnects the left sheaves 1145 for concurrent rotation; and, a right shaft 2150 supports and interconnects the right sheaves 2145 for concurrent rotation. The shafts 1150, 2150 are depicted as extending coaxially about a common axis 1155, but can extend about separate axes (not shown) that are located above the furnace opening 1075 and that preferably extend parallel to the furnace face 1050. Arrows 1160, 1165 indicate opposite directions of rotation about the axis 1155 (see FIG. 6). When the shafts 1150, 2150 are rotated in the direction 1160, upper portions of the door support cables 1130, 2130 wind onto curved grooves or tracks 1146, 2146 that extend along the perimeters of the sheaves 1145, 2145. As the upper portions of the door support cables 1130, 2130 wind onto and are received within the tracks 1146, 2146, lower portions of the cables 1130, 2130 are raised, thereby causing the door panels 1100, 2100 to be raised out of their closed positions. When the shafts 1150, 2150 are rotated in the opposite direction 1165, upper portions of the door support cables 1130, 2130 unwind from the door support sheaves 1145, 2145, which causes lower portions of the cables 1130, 2130 to lower the door panels 1100, 2100 toward their closed positions.

While counterweights normally are provided for the door panels 1100, 2100 (usually in much the same shaft-connected manner that is depicted in FIGS. 1 and 3), these conventional components do not form elements of the present invention, and need not be further described in order to enable those who are skilled in the art to make and utilize features of the present invention.

In preferred practice, the sheaves 1145 are identical one with another; the sheaves 2145 are identical one with another; the door support cables 1130, 2130 all are identical one with another; and, the left sheaves 1145 are mirror image reversals of the right sheaves 2145. Thus, only one of the four cable-to-sheave connections needs to be described in order for the character of all four of these connections to be understood.

Referring to FIG. 8, one of the right sheaves 2145 and an upper end region 2140 of an associated one of the right door support cables 2130 are shown. The depicted sheave 2145 has a centrally located hub 2200 through which the shaft 2150 extends, and to which the shaft 2150 is rigidly connected. The sheave 2145 also has a disc-like central portion 2205 that connects with a rim 2210 that defines the curved, perimetrically extending, cable receiving track 2146. A generally triangular notch 2220 is formed in one side of the sheave 2145. The notch 2220 extends into the central portion 2205 and also interrupts the rim 2210 and the track 2146.

To connect the door support sheaves 1145, 2145 with the door support cables 1130, 2130 suitable connectors may be provided on the sheaves 1145, 2145 to receive suitable connection formations carried by the upper end regions of the cables 1130, 2130. Referring to FIG. 8, a pair of straps 2225 have their inner end regions connected to the central portion 2205 of the depicted sheave 2145, and have their outer end regions positioned to extend in spaced relationship on opposite sides of the triangular notch 2220 to define opposite sides of a yoke 2230 (similar yokes 1230 are defined on the left sheaves 1145, see FIGS. 5 & 6). An eyelet 2141 is provided on the upper end region 2140 of the depicted door support cable 2130. The eyelet 2141 extends into the triangular notch 2220 and is received within the yoke 2230. A connection pin 2235 extends through aligned holes formed through opposite sides of the yoke 2230 and through the eyelet 2141 to connect the cable 2130 to the sheave 2145 (similar connection pins 1235 are used with the yokes 1230). The yoke 2230 and the connection pin 2235 cooperate to position the upper end region 2140 of the cable 2130 in alignment with the track 2146 so that, when the sheave 2145 rotates in the direction 1160, upper portions of the cable 2130 will be received by the track 2146 as the cable 2130 winds onto the sheave 2145.

In the manner that has been described in conjunction with the single-door-panel embodiment of FIGS. 1–4 and 7, relatively little rotation of the sheaves 1145, 2145 is needed to effect horizontal movements of the door panels 1100, 2100 away from the furnace face 1050 during initial raising of the door panels 1100, 2100 from their closed positions. Likewise, relatively little rotation of the sheaves 1145, 2145 is needed to effect horizontal movements of the door panels 1100, 2100 toward the furnace face 1050 during final lowering of the door panels 1100, 2100 into their closed positions. Thus the so-called "H-type" movements that are achieved with the door panel 100 are achieved in substantially the same manner with the door panels 1100, 2100, and a full description thereof need not be repeated here in order for those who are skilled in the art to fully understand these features.

What is different about the manner in which the left sheaves 1145 interact with the left door support cables 1130, and about the manner in which the right sheaves 2145 interact with the right door support cables 2130 has to do with the helical nature of the grooves or tracks 1146, 2146 that are defined by the sheaves 1145, 2145—with the left sheaves 1145 defining curved tracks 1146 that extend leftwardly along the shaft axis 1155 as the left tracks 1146 wrap about the shaft rotation axis 1155, whereas the right sheaves 2145 defining curved tracks 2146 that extend rightwardly along the shaft axis 1155 as the right tracks 2146 wrap about the shaft rotation axis 1155. As such, the left sheave tracks 1146 are designed to move the left door panel 1100 leftwardly during opening, and the right sheave tracks 2146 are designed to move the right door panel 2100 rightwardly during opening—to progressively separate adjacent end surfaces 1101, 2101 of the left and right door panels 1100, 2100 during raising. Likewise, the left sheave tracks 1146 are designed to move the left door panel 1100 rightwardly during closing, and the right sheave tracks 2146 are designed to move the right door panel 2100 leftwardly during closing—to progressively bring the adjacent end surfaces 1101, 2101 of the left and right door panels 1100, 2100 into engagement during lowering so that, when the door panels 1100, 2100 are lowered to their closed positions, the door panels end surfaces 1101, 2101 will engage to enable the door panels 1100, 2100 to cooperatively close the furnace opening 2075.

As will be apparent from the foregoing description, features of the present invention can be embodied in a variety of ways in systems for raising and lowering furnace doors. In one simple form, existing cable systems for raising and lowering furnace doors along substantially linear paths of travel can be supplemented by the provision of means for engaging the vertically extending cable reaches to move them short distances horizontally to effect corresponding short distance horizontal movements of the furnace doors as the doors are being raised and lowered. In a more preferred form, rotatable sheaves or drums can be provided that connect with upper portions of the vertically extending cable reaches to concurrently perform both the task of vertically moving cable reaches to raise or lower the doors, and the task of horizontally moving the cable reaches to impart desired horizontal movements to the doors. In a still more preferred form, the character of connections that are formed between the cables and the rotatable drums or sheaves can be tailored to provide desired H-types of door movement, and the configurations of cable-receiving tracks that are defined by the drums or sheaves can be tailored to provide desired L- and R-types of horizontal door movement that are coordinated with the raising and lowering movements of furnace doors.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "leftwardly," "rightwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A cable system for raising a furnace door panel to at least partially open, and for lowering the furnace door panel to at least partially close a furnace opening that is formed through an upstanding furnace face of an industrial furnace, comprising:

a) cable means for connection to the furnace door panel and for defining at least one reach of flexible cable that extends upwardly from the door panel and that can be raised, lowered and held in selected positions relative to the furnace opening;

b) operating means connected to the cable means for raising the at least one reach of flexible cable to raise the door panel relative to the furnace opening to an open position wherein the door panel at least partially opens the furnace opening, and for lowering the at least one reach of flexible cable to lower the door panel relative to the furnace opening to move the door panel toward a closed position wherein the door panel at least partially closes the furnace opening; and, c) wherein the operating means includes horizontal positioning means for engaging the at least one reach of flexible cable at a location above the furnace opening for effecting forward horizontal movement of the at least one reach of flexible cable in a forward direction away from the furnace face during raising of the door panel, and for effecting rearward horizontal movement of the at least one reach of flexible cable in a rearward direction toward the furnace face during lowering of the door panel.

2. The system of claim 1 wherein:

a) the operating means is configured to move the door panel along a substantially vertical path of travel in raising and lowering the door panel between the open and closed positions; and, b) the horizontal positioning means is configured to effect said horizontal movement of the door panel while the door panel is being raised and lowered along a selected segment of the vertical path of travel.

3. The system of claim 2 wherein the horizontal positioning means is configured to locate the selected segment near the lower end of the substantially vertical path of travel thereby to effect said forward horizontal movement during initial raising of the door panel away from the closed position, and to effect said rearward horizontal movement during final lowering of the door panel toward the closed position.

4. The system of claim 1 wherein the furnace opening has opposed left and right ends, wherein the door panel is movable when not in the closed position in a leftward direction toward the left end and in a rightward direction toward the right end, and wherein the horizontal positioning means is operable to engage the at least one reach of flexible cable to selectively effect horizontal leftward movement and horizontal rightward movement of door panel during raising and lowering of the door panel.

5. The system of claim 4 wherein:

a) the operating means is configured to move the door panel along a substantially vertical path of travel in raising and lowering the door panel between the open and closed positions; and, b) the horizontal positioning means is configured to effect the horizontal leftward and rightward movements of the door panel while the door panel is being raised and lowered along a selected segment of the vertical path of travel.

6. The system of claim 5 wherein the horizontal positioning means is configured to locate the selected segment near the lower end of the substantially vertical path of travel thereby to effect a selected one of said horizontal leftward and rightward movements of the door panel during initial raising of the door panel away from the closed position, and to effect the opposite of said horizontal leftward and rightward movements of the door panel during final lowering of the door panel toward the closed position.

7. The system of claim 1 wherein the operating means additionally includes:

a) rotatable means for rotation about a generally horizontally extending axis of rotation located above the furnace opening and extending substantially parallel to the furnace face; and, b) wherein the rotatable means includes track defining means for defining a cable-receiving track that rotates about the axis of rotation as the rotatable means is rotated about the axis of rotation 1) for winding upper portions of the at least one reach of cable onto the track when the rotatable means is rotated in one direction of rotation about the axis of rotation to raise lower portions of the at least one reach of cable to raise the door panel and to move the door panel in the forward direction away from the furnace face as the door panel is raised, and 2) for unwinding the upper portions of the at least one reach of cable from the track when the rotatable means is rotated in an opposite direction of rotation about the axis of rotation to lower the at least one reach of cable to lower the door panel and to move the door panel in the rearward direction toward a position of engagement with the furnace face as the door panel is lowered.

8. The system of claim 7 wherein the means for engaging the at least one reach of flexible cable to horizontally move the at least one reach includes connection means for defining a point of connection between the cable means and the rotatable means at a location adjacent the cable-receiving track.

9. The system of claim 7 wherein:

a) the rotatable means includes at least one sheave that is rotatable about the generally horizontally extending axis of rotation, wherein the sheave has a curved perimeter that curves about the generally horizontally extending axis of rotation, and wherein the cable-receiving track takes the form of an arc that extends along at least a portion of the curved perimeter of the sheave;

b) the cable means includes at least one length of flexible cable that has a lower part connected to the door panel and an upper part connected to the curved perimeter of the sheave at a point of connection located near one end of arc of the cable-receiving track; and, c) the rotatable means is operable to orient the sheave 1) so that, during initial raising of the door panel from the closed position and during final lowering of the door panel toward the closed position, the point of connection is situated forwardly with respect to, and below the axis of rotation; 2) so that, when the sheave rotates in said one direction of rotation during initial raising of the door panel the point of connection moves forwardly and upwardly; and 3) so that, when the sheave rotates in said opposite direction of rotation during final lowering of the door panel the point of connection moves rearwardly and downwardly.

10. The system of claim 1 wherein the furnace opening has left side bordering a leftward portion of the furnace openings and a right side bordering a rightward portion of the furnace opening, wherein the furnace door panel, when in its closed position, at least partially closes a selected one of the leftward and rightward portions of the furnace opening, and wherein the operating means includes means for engaging the at least one reach of flexible cable at a location above the furnace opening to horizontally move the at least one reach in a selected sideward direction selected from a leftward direction and a rightward direction during raising of the door panel, and in an opposite sideward direction during closing of the door panel.

11. The system of claim 10 wherein the operating means additionally includes:

a) rotatable means for rotation about a generally horizontally extending axis of rotation located above the furnace opening and extending substantially parallel to the furnace face; and, b) wherein the rotatable means includes track defining means for defining a cable-receiving track that extends substantially helically about the axis of rotation and that rotates about the axis of rotation as the rotatable means is rotated about the axis of rotation 1) for winding upper portions of the at least one reach of cable onto the track when the rotatable means is rotated in one direction of rotation about the axis of rotation to raise lower portions of the at least one reach of cable to raise the door panel and to move the door panel in the forward direction away from the furnace face and in said selected sideward direction as the door panel is raised, and 2) for unwinding the upper portions of the at least one reach of cable from the track when the rotatable means is rotated in an opposite direction of rotation about the axis of rotation to lower the at least one reach of cable to lower the door panel and to move the door panel in the rearward direction toward a position of engagement with the furnace face and in said opposite sideward direction as the door panel is lowered.

12. A system for raising a furnace door panel to at least partially open, and for lowering the furnace door panel to at least partially close a furnace opening formed through an upstanding wall of an industrial furnace, comprising:

a) cable means for connection to the door panel for defining at least one reach of flexible cable that extends upwardly from the door panel for supporting, raising, and lowering the door panel;

b) support means for defining an axis of rotation that extends generally horizontally at a location spaced above the furnace opening;

c) rotatable means for connection to the support means for rotation about the axis of rotation for defining a curved cable-receiving track that curves to define an arc that wraps at least part way around the axis of rotation 1) for wrapping upper portions of the reach of cable onto the track when the rotatable means is rotated in one direction of rotation about the axis while lower portions of the reach of cable depend from the rotatable means along a vertical path to the door panel for raising the door panel in response to rotation of the rotatable means in said one direction of rotation, and 2) for unwrapping the upper portions of the reach of cable from the track when the rotatable means is rotated in the opposite direction of rotation about the axis while lower portions of the reach of cable depend from the rotatable means along a vertical path to the door panel for lowering the door panel in response to rotation of the rotatable means in said opposite direction of rotation; and, d) connection means for establishing a connection between the cable means and the rotatable means at a location near one end of the curved cable-receiving track for moving the vertical path away from the furnace face during raising of the door panel, and for moving the vertical path toward the furnace face during lowering of the door panel to thereby move the door panel away from the furnace face during raising and toward the furnace face during lowering.

13. The system of claim 12 wherein the arc that is defined by the cable-receiving track also extends at least a short distance axially relative to the axis of rotation as it wraps at least part way around the axis of rotation to thereby cause the vertical path to move axially in a first direction along the axis of rotation as the door panel is raised, and to move axially in a direction opposite to the first direction along the axis of rotation as the door panel is lowered, to thereby move the door panel in said first direction during raising and in said direction opposite to the first direction during lowering.

14. A system for raising and lowering a furnace door panel to at least partially open and to at least partially close a furnace opening that is defined where a furnace passage opens through a substantially vertically extending furnace face, comprising:

a) rotatable means for being rotated about an axis of rotation located above the furnace opening;

b) cable means for being wound onto and off of the rotatable means, and for defining at least one reach of flexible cable that depends from the rotatable means for connection to the furnace door panel for supporting the furnace door panel, for lowering the furnace door panel toward and into a closed position adjacent the furnace face for at least partially closing the furnace opening, and for raising the furnace door panel from the closed position toward and to an open position for at least partially opening the furnace opening; and, c) positioning means for controlling the interaction that takes place as the cable means is wound onto and off of the rotatable means for causing said at least one reach of flexible cable to execute horizontal components of movement as the cable means is wound onto and off of the rotatable means for thereby causing the furnace door panel to execute substantially the same horizontal components of movement as the furnace door panel is raised and lowered by the cable means.

15. The system of claim 14 wherein the positioning means includes connection means for defining at least one fixed connection between the cable means and the rotatable means, with the point of connection being arranged to execute forward movement relative to the furnace face as the rotatable means is rotated about the axis during initial raising of the furnace door panel from the closed position to thereby cause corresponding forward horizontal movement of the door panel, and to execute rearward movement relative to the furnace face as the rotatable means is rotated about the axis during lowering of the furnace panel into the closed position.

16. The system of claim 14 wherein the positioning means includes groove-defining means for defining at least one curved groove that extends along at least a portion of a perimetrically extending surface of the rotatable means for receiving portions of the cable means that wind onto and off of the rotatable means.

17. The system of claim 16 wherein the at least one curved groove has at least one curved portion thereof that extends non-parallel to an imaginary plane that is perpendicularly intersected by said axis of rotation, and said at least one curved portion is configured to interact with the cable means while receiving said cable means as said portions are wound onto and off of the rotatable means to cause said at least one reach of flexible cable to execute said horizontal components of movement as said portions of the cable means are wound onto and off of the rotatable means.

18. A system for raising and lowering a furnace door panel to at least partially open and to at least partially close a furnace opening that is defined where a furnace passage opens through a substantially vertically extending furnace face, comprising:

a) vertically extending cable means for being connected to the furnace door panel for lowering the furnace door panel to a closed position adjacent the vertically extending face of the furnace to at least partially close the furnace opening, and for raising the furnace door panel to an open position to at least partially open the furnace opening;

b) rotatable means for being rotated about an axis located above the furnace opening for being connected to the cable means for winding portions of the cable means onto the rotatable means to raise the furnace door panel, and for unwinding the cable portions from the rotatable means to lower the furnace door panel, and for defining a selected portion of the rotatable means 1) that moves forwardly away from the furnace face as the furnace door panel is raised from the closed position and 2) that moves rearwardly toward the furnace face as the furnace door is lowered into the closed position; and, c) cable positioning means for connecting the cable means to the selected portion for positioning the cable means to move the furnace door forwardly away from the furnace face to disengage the furnace door from the furnace face as the furnace door is raised, and for positioning the cable means to move the furnace door rearwardly toward the furnace face to engage the furnace door with the furnace face as the furnace door is lowered.

19. The system of claim 18 wherein the rotatable means includes at least two sheaves of substantially identical configuration and means supporting the sheaves at spaced locations above the furnace opening for concurrent rotation about a common axis that extends substantially parallel to the furnace face, and wherein the cable means includes a plurality of lengths of cable wherein each of the cable lengths is associated with and connected to a separate one of the sheaves, and wherein each of the cable lengths is connected to the door for raising the furnace door in response to concurrent rotation of the sheaves about the common axis in one direction of rotation, and for lowering the furnace door in response to concurrent rotation of the sheaves about the common axis in an opposite direction of rotation.

20. The system of claim 19 wherein the sheaves define groove means for receiving upper portions of the cable lengths as the sheaves are rotated concurrently about the common axis in said one direction of rotation.

21. The system of claim 20 wherein the groove means include a plurality of grooves that each receives an upper portion of a separate cable length as the sheaves are rotated concurrently about the common axis in said one direction of rotation, and the grooves are configured to move lower portions of the cable lengths in a first direction that parallels the common axis as the sheaves are rotated concurrently about the common axis in said one direction of rotation, and to move the lower portions of the cable lengths in a second direction that is opposite to the first direction as the sheaves are rotated concurrently about the common axis in said other direction of rotation to thereby move the furnace door in said first direction as the furnace door is raised, and to move the furnace door in said second direction as the furnace door is lowered.

22. A system for raising and lowering a set of furnace doors that are arranged side by side to cooperate in at least partially closing and in at least partially opening an elongate furnace opening defined in an upstanding furnace face of an industrial furnace, wherein the set of doors includes at least a left door configured to at least partially close and to at least partially open a left portion the elongate furnace opening, and at least a right door configured to at least partially close and to at least partially open a right portion of the elongate furnace opening, comprising:

a) vertically extending cable means connected to the set of furnace doors for raising and lowering the doors between a closed position wherein the doors of the set cooperate to at least partially close the furnace opening, and an open position wherein the doors of the set cooperate to at least partially open the furnace opening, wherein the cable means includes a plurality of sets of vertically extending cable reaches, with each of the sets of cable reaches being associated with and connected to a separate one of the doors such that each of the doors may be raised and lowered independently of the other doors by raising and lowering the set of cable reaches that is associated therewith and connected thereto;

b) rotatable means for rotation about at least one axis located above the furnace opening, for being connected to the cable means for winding portions of the cable means onto the rotatable means to raise the doors of the set by raising the associated sets of cable reaches, and for unwinding, the cable portions from the rotatable means to lower the doors of the set by lowering the associated sets of cable reaches; and, c) cable positioning means for engaging at least one of the associated sets of cable reaches to cause the door that is associated therewith and connected thereto be moved horizontally in one direction while being raised so as to move said associated door, during raising, out of engagement with a furnace component surface that is engaged by said associated door when the set of doors is in the closed position, and to cause said associated door to be moved horizontally in an opposite direction while being lowered so as to move said associated door, during lowering, into engagement with said furnace component surface.

23. The system of claim 22 wherein said upstanding furnace face comprises said furnace component face, and said one direction is selected to cause said associated door to move away from said upstanding furnace face during raising, and to move toward said upstanding furnace face during lowering.

24. The system of claim 22 wherein said furnace component face is defined by another of the doors of the set that is engaged by said associated door when the doors of the set are in the closed position, and said one direction is selected to cause said associated door to move away from said another of the doors during raising, and to move toward said another of the doors during lowering.

25. The system of claim 24 wherein the cable positioning means is configured to also engage the set of cable reaches that is associated with said another of the doors for also causing said another of the doors to move away from said associated door during raising of said another of the doors, and to move toward said associated door during lowering of said another of the doors.

26. A system for raising and lowering a set of furnace doors that are arranged side by side to cooperate in at least partially closing and in at least partially opening an elongate furnace opening defined in an upstanding furnace face of an industrial furnace, wherein the set of doors includes at least a left door configured to at least partially close and to at least partially open a left end region of the elongate furnace opening, and at least a right door configured to at least partially close and to at least partially open a right end region of the elongate furnace opening, and wherein, when the doors of the set are lowered to a closed position, adjacent ones of the doors have adjacent ends that engage to cooperate in at least partially closing the furnace opening, comprising:

a) vertically extending cable means connected to the set of furnace doors for raising and lowering the doors between a closed position wherein the doors of the set cooperate to at least partially close the furnace opening, and an open position wherein the doors of the set cooperate to at least partially open the furnace opening;

b) rotatable means for rotation about at least one axis located above the furnace opening, for being connected to the cable means for winding portions of the cable means onto the rotatable means to raise the doors of the set, and for unwinding the cable portions from the rotatable means to lower the doors of the set; and, c) cable positioning means for engaging the cable means during raising and lowering of the doors of the set to cause said adjacent ends that engage when the doors of the set are in the closed position to disengage when the doors of the set are raised out of the closed position.

27. The system of claim 26 wherein the rotatable means includes sheave means for defining curved, perimetrically extending groove means configured to receive said cable portions.

28. The system of claim 26 wherein the doors of the set engage the upstanding furnace face when in the closed position, and wherein the cable position means also functions to disengage the doors from the furnace face when the doors are raised out of the closed position.

29. The system of claim 28 wherein the cable positioning means includes means for defining a connection between said cable means and said rotatable means, with the location of the connection being selected such that, as the rotatable means is rotated in one direction about said at least one axis to cause said cable portions to wind onto said rotatable means to raise the set of doors, the location of the connection is caused to move away from the furnace face, and such that, as the rotatable means is rotated in an opposite direction about said at least one axis to cause said cable portions to wind off of said rotatable means to lower the set of doors, the location of the connection is caused to move toward the furnace face.

30. In an industrial furnace having left and right doors that can be lowered to cooperatively close an elongate furnace opening formed through a substantially vertically extending furnace face, and that can be raised to cooperatively open the furnace opening, and having left cables that are connected to the left door for raising and lowering the left door, and right cables that are connected to the right door for raising and lowering the right door, the improvement comprising:

a) rotatable means located above the furnace opening for winding the left and right cables thereon to raise the left and right doors, and for unwinding the left and right cables therefrom to lower the left and right doors; and, b) cable positioning means for engaging the left and right cables 1) to effect horizontal movement of the left and right doors away from the furnace face as the left and right doors are raised, 2) to effect horizontal movement of the left and right doors toward the furnace face as the left and right doors are lowered, 3) to effect horizontal movement of the left and right doors away from each other as the left and right doors are raised, and 4) to effect horizontal movement of the left and right doors toward each other as the left and right doors are closed.

* * * * *